US005511728A

United States Patent [19]

Bailey

[11] Patent Number: 5,511,728

[45] Date of Patent: Apr. 30, 1996

[54] DUAL FLUID ATOMIZER FOR HIGH SOLIDS SOIL PASTE CONTAINING PEBBLES OR AGGLOMERATES

[75] Inventor: Ralph T. Bailey, Uniontown, Ohio

[73] Assignee: The Babcock & Wilcox Company, New Orleans, La.

[21] Appl. No.: 252,805

[22] Filed: Jun. 2, 1994

[51] Int. Cl.[6] ..... F23D 11/10

[52] U.S. Cl. ..... 239/423; 239/427.3; 239/433; 239/591; 239/601

[58] Field of Search ..... 239/418, 416.4, 239/416.5, 423, 427, 591, 424.5, 601, 427.3, 433

[56] References Cited

U.S. PATENT DOCUMENTS

| | | | |
|---|---|---|---|
| 1,192,589 | 7/1916 | Whitney | 239/416.4 X |
| 1,280,068 | 9/1918 | Moorhouse | 239/416.4 |
| 1,653,536 | 12/1927 | Barbour | 239/423 |
| 4,240,788 | 12/1980 | Naito et al. | 432/136 |
| 4,622,007 | 11/1986 | Gitman | 239/423 X |
| 4,717,334 | 1/1988 | Newman | 239/591 |

OTHER PUBLICATIONS

Second Quarterly Report, "Cyclone Furnace for Waste Treatment of Contaminated Soil (Phase II)", Nov. 1, 1991 RDD: 92: 4191–01–02:01, Prepared for U.S. EPA, Contract No. Cr–815800–02–0.

Site Demonstration of B&W Cyclone Vitrification Process in Nov. 1991 at the Alliance Research Center.

Draft Final Report–"Cyclone Furnace for Waste Treatment of Contaminated Soil"—RDD–92: 4191–11–01:01, Jun. 2, 1992. Prepared for U.S. EPA, Contract No. CR–815800–02–0.

Development of Emerging Technologies within the SITE Program, US EPA, NTIS, 1992.

*Primary Examiner*—Kevin P. Weldon

*Attorney, Agent, or Firm*—Daniel S. Kalka; Robert J. Edwards

[57] ABSTRACT

An atomizer for atomizing a high solids soil paste containing pebbles or agglomerates includes an inner conduit for channeling the paste and an outer conduit surrounding the inner conduit whereby the outer conduit and the inner conduit define an annular space therebetween in which a flow of compressed air is channeled in the space. The inner conduit and the outer conduit have a discharge end which is connected to a discharge spraying head made of a wear-resistant and a high temperature-resistant material such as tungsten carbide. The spraying head has three walls which accommodate a flow plate which is connected at the top of the first wall and third wall for defining a rectangular opening of the spraying head. The flow plate has two air passages cut therethrough, which are also rectangular, which channel air from the annular space into the spraying head for dispersing the soil paste into an atomized spray which is discharged out of the opening.

15 Claims, 2 Drawing Sheets

DUAL FLUID ATOMIZER FOR HIGH SOLIDS SOIL PASTE CONTAINING PEBBLES OR AGGLOMERATES

This invention was made with government support under Contract No. CR-815800-02-0 awarded by the U.S. Environmental Protection Agency (EPA). The government has certain rights in this invention.

BACKGROUND OF THE INVENTION

1. Field of the Invention

The present invention relates, in general, to atomizers and, in particular, to a new and useful device for atomizing soil or other substances having a high solids content.

2. Description of the Related Art

Atomizers have long been used to disperse liquids or slurries into a spray of droplets. The energy required to break up and disperse the liquid or slurry into droplets comes from a variety of sources. With dual fluid atomizers, this energy comes from a high velocity gas that provides the shearing forces necessary to break the liquid or slurry into droplets. The gas used for atomizing the liquid is usually air or steam. The gas and liquid are either mixed internal to the atomizer and discharged through holes at high velocity, or the high velocity gas and liquid are mixed external to the atomizer.

The diameter of the passages that discharge the gas, liquid, or gas-liquid mixture are usually of a small diameter ranging anywhere from 0.05 to 0.3 inches so that high velocities can be obtained at the desired flow rates of gas and liquid.

Dual fluid slurry atomizers have been developed for atomizing liquid-solid mixtures. These slurries contain small solid particles that are suspended in the liquid. Caution must be used when atomizing slurries to insure that the largest solid particle of agglomerate of particules in the slurry can easily pass through the smallest diameter passage of the atomizer. Examples of slurry atomization are lime and flyash slurries used in dry sulfur removal devices in the electric utility industry, spray drying, and coal-water fuel used as a substitute for fuel oil in combustion processes.

In all of these applications, the mass fraction of solids in the slurries or the chemistry of the slurries are designed so that the slurries have flow properties similar to liquids. That is, the slurry viscosity is sufficiently low so that it can be transported through pipes using traditional or wear-resistant pumps. These slurries are usually limited to solid mass fractions on the order of 50%. By using specialized chemistry and control of the particle size distribution, solid mass fractions on the order of 70% can be attained.

Presently, there is no known atomizer which can accommodate high solid slurries with large particle diameters while at the same time provide efficient flow rates.

SUMMARY OF THE INVENTION

The present invention is a soil paste atomizer comprising two concentric tubes or pipes. One end of one tube is connected to a supply of a slurry paste; and one end of the other tube is connected to a supply of compressed air. The high solids paste is supplied to the inner tube, while the air used for atomization is supplied to the annular space between the tubes. At an outlet end of the atomizer, flow passages between the soil tube and the annulus provide high velocity air streams that atomize the soil paste.

The outlet end of the soil paste tube is rectangular and is attached to a tungsten carbide insert. The tungsten carbide insert has three adjacent walls and a flow distributor plate having air passages cut therethrough and is a top plate which forms the fourth wall. The four walls form a rectangular opening for the atomized spray. Additionally, the flow passages are rectangular and machined into the flow distributor plate for providing directional high velocity air streams that atomize the soil paste.

The flow passages are inclined at different angles relative to the axis of the atomizer in order to distribute the atomized soil over a large area. The tungsten carbide insert is used to minimize erosion from the high velocity air and soil particles impacting the walls of the insert.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
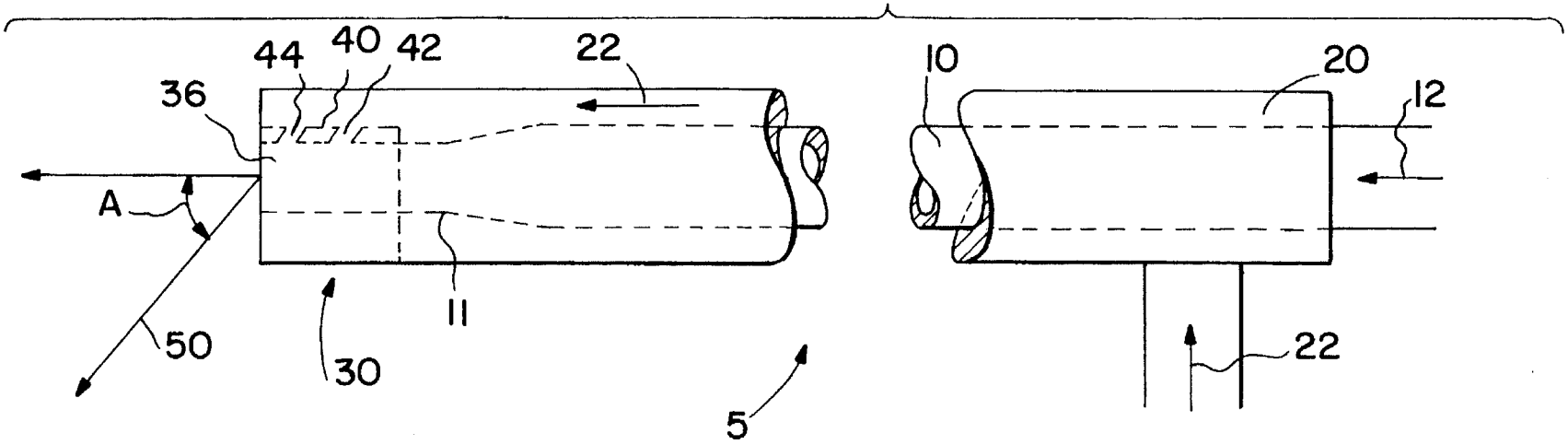
FIG. 1 is a schematic view illustrating an atomizer according to the present invention.

As illustrated in FIG. 1, the present invention is an atomizer, generally designated 5, comprising an inner conduit or tube 10 for channeling a material flow 12 and an outer tube or conduit 20 surrounding or disposed concentrically around the inner tube 10. Outer tube 20 is spaced away from the inner tube 10 for channeling a flow of compressed air 22 in the annular space between the inner tube 10 and the outer tube 20.

The material flow 12 is a material having a high content of particles, agglomerates or pebbles and can be a soil paste, a slurry, a wet concrete mixture, sludge, etc.

Figure 2:
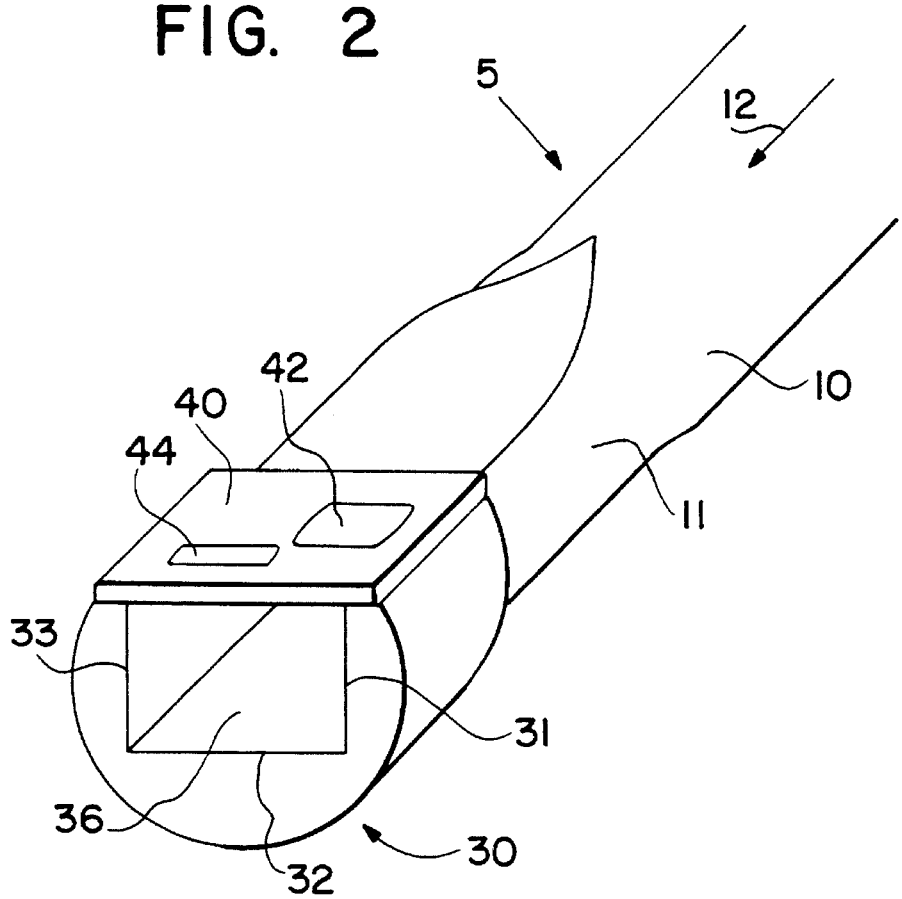
FIG. 2 is a partial perspective view of a spraying head of FIG. 1.

Both the soil paste 12 and the compressed air flow 22 are channeled to a discharge end 11 common to both the inner tube 10 and the outer tube 20. FIG. 2 shows a wear-resistant and high temperature-resistant insert or spraying head 30 which is connected to the discharge end 11 for discharging an atomized spray 50 (FIG. 1) through opening 36 of the spraying head 30.

Insert 30 is made of a wear-resistant and high temperature-resistant material such as tungsten carbide or other materials containing nitrides or carbides. Insert 30 has three walls 31, 32 and 33 wherein the first wall 31 is connected to and perpendicular to the second wall 32 and the second wall 32 is perpendicular to and connected to the third wall 33.

A flow distributor plate 40, which is a flat plate, is connected to the insert 30 at the top of walls 31 and 33 thereby forming an opening 36 which is rectangular. Additionally, the discharge end 11 of inner tube 10 can also have a rectangular profile for aligning with the rectangular shape of the opening 36 for facilitating a smooth transition of the soil paste 12 from inner tube 10 into the opening 36 of the insert or spraying head 30.

Flow plate 40 has a first air passage 42 and a second air passage 44 cut therethrough which allows airflow 22 to be channeled from the annular space between inner tube 10 and outer tube 20 through air passages 42 and 44 and into the spray opening 36 of the spraying head 30 for being forcibly mixed into the soil paste 12 which disperses the soil paste 12 into an atomized spray 50 which is sprayed out of the opening 36 of the spraying head 30 at a spraying angle A as illustrated in FIG. 1. The spraying angle A of the atomized spray 50 has an angle of inclination no greater than 60° to the axis of the atomizer 5.

Figure 3:
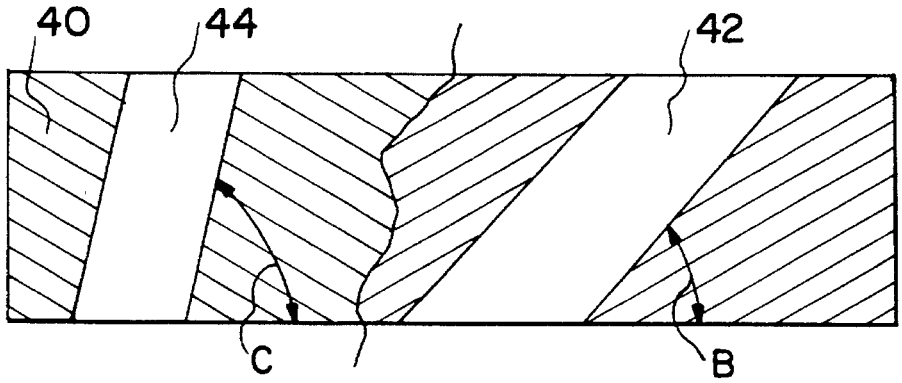
FIG. 3 is a view in cross-section of a flow distributor plate of FIG. 2.

As shown in FIG. 2, air passages 42 and 44 of the flow plate 40 are rectangular in shape. Moreover, the first air passage 42 has an angle of inclination B with the axis of the atomizer 5 (FIG. 1) and the second air passage 44 has an angle of inclination C with the axis of the atomizer 5. Angles of inclination B and C are at a different angle as illustrated in FIG. 3. Because angle B is different than angle C for air passages 42 and 44 respectively, the atomized soil 50 can be sprayed or distributed over a larger area.

The wear-resistant high-temperature material of spraying head or insert 30 minimizes erosion which would otherwise result from the high velocity of the air flow 22 and the soil flow 12 impacting against walls 31, 32 and 33. Additionally, the flow plate 40 can also be made of a high temperature-resistant and wear-resistant material for minimizing erosion.

The soil paste atomizer 5 provides a means of injecting the soil 12 into a cyclone furnace for the purposes of vitrifying the soil 12. Soil vitrification is one technique for immobilizing heavy metals or other contaminants contained in soil or other solid material. During a period from 1990 to 1992, tests were conducted wherein the contaminated soil 12 was injected into a cyclone furnace using two different techniques: dry injection achieved by pneumatic transport of the dry soil, and wet injection achieved by slurrying the soil into a paste and pumping the soil paste to an atomizer that dispersed the soil in the cyclone so that it could be dried and vitrified.

Paste injection has several advantages over dry injection of contaminated soil. The disadvantages of dry injection are as follows: usually, dry pneumatic transport of soil requires pre-drying of the soil to about 5% moisture levels so that it will flow freely and not form agglomerates. Also, the injection of dry powder can lead to a great quantity of airborne dust that contains heavy metals and other air toxics which results in a safety hazard. Additionally, once injected into a cyclone furnace, the fine particulate can be entrained in the combustion gas and carried out of the furnace, thereby escaping the vitrification process.

With an atomized paste injection system according to the present invention, many of these above-listed problems do not exist. However, in order to implement paste injection, an atomizer that can operate under the required conditions must be available.

The present invention has several features to successfully atomize and vitrify the soil paste. These include: the ability to process soil paste containing pebbles or agglomerates up to 0.375 inches in diameter with an atomizer of 400 lb/hr capacity while consuming no greater than ½ lb. of air per lb. of soil paste for atomization; the ability to atomize a soil paste with only 15% to 25% moisture content; the ability to atomize a soil paste with little or no back pressure due to the mixing of the soil paste and the air; the ability to provide a wide angle spray that can be directed toward the hottest part of the cyclone; and the ability to provide an atomized droplet/particle size distribution that is large enough to inhibit entrainment and carry out from the furnace, yet small enough to prevent a buildup of dry, unmelted deposit in the furnace.

The present invention has numerous advantages over previous dual fluid atomizers. The large diameter, straight-through design of the soil paste tube 10 permits low pressure injection of soil paste 12 with 75% to 85% solids by weight. Soils with higher solids contents can likewise be atomized with the atomizer 5 as long as the soil can be transported to the atomizer. The soil used to form this paste is naturally occurring, and does not require any special grinding or chemical additives. The open channel design of the present invention also permits the passage of large pebbles or agglomerates, for example, up to 0.375 inches in diameter for an atomizer with 400 lb/hr soil paste capacity. Larger diameter pebbles or agglomerates would be accomodated with larger capacity atomizer.

The low pressure, high solids paste could be prone to dry-out, caking, and pluggage in the soil tube because the discharge end of the atomizer is inserted into a high temperature (3000° F.) combustion environment. This problem is mitigated by the annular flow passage of the air 22 within tube 20 around the circumference of the soil tube 10. As air 22 flows toward the discharge end 11 of the atomizer 5, it is heated by the high temperature surroundings, but provides insulation to the soil paste 12 in the center tube 10. At the discharge end 11 of the tube 10, the heated air 22 then assists the dry-out of the soil paste 12 during atomization.

The rectangular slots 42 and 44 that provide high velocity air jets are designed to provide a wide dispersion of the atomized soil 50. The soil 50 is sprayed over the angle A ranging from about 14° to 60° with the axis of atomizer 5 so that it is well dispersed in the furnace. This wide dispersion assists in the melting process by preventing the local buildup of unmelted deposits. The spray angle A is adjustable by varying the design and/or configuration of the air slots 42 and 44.

Wear and erosion of the atomizer components by the slurry are minimized since the soil velocities are low in all locations except the discharge end 11 of the atomizer 5. At the discharge end 11 of the atomizer 5, the high velocity air jets 42 and 44 can cause erosion. This location on the atomizer 5 is protected by using heat and wear-resistant ceramics or other materials such as the tungsten carbide for the insert 30.

Test results show that soil vitrification using the paste atomizer 5 provide the same or better performance than dry injection. With the paste injection, a higher fraction of heavy metals was captured in the furnace slag, less flyash was produced, and the metals captured in the slag were less prone to leaching.

Although the above-mentioned embodiment for the present invention provides for air passages at the flow plate 40, i.e. the fourth wall, these air flow passages at the discharge end of the atomizer can also be located in any one of the other three rectangular walls 31, 32 and 33. These other locations can be used to both shape and direct the atomized spray. As the capacity of the atomizer 5 is increased, the high velocity air can be introduced at these other locations in order to adequately atomize the paste.

In the embodiment described above, three of the four rectangular walls at the discharge opening 36 of the atomizer 5 are fabricated from tungsten carbide which provides wear and temperature resistance, as well as efficient fabrication.

Other materials such as nitrides or carbides can be used on all four walls.

Although the atomizer 5 atomizes soil paste, it is not limited to this application. Materials such as concrete, sludge, or other high solids slurries having large agglomerates or pebbles can also be atomized with this device.

While specific embodiments of the invention have been shown and described in detail to illustrate the application of the principles of the invention, it will be understood that the invention may be embodied otherwise without departing from such principles.

What is claimed is:

1. An atomizer for atomizing a material having a high content of solid particles, the atomizer comprising:

an inner conduit for channeling a flow of the material;

an outer conduit surrounding the inner conduit, the outer conduit and the inner conduit defining an annular space therebetween, the outer conduit for channeling a flow of air in the space;

the inner conduit and the outer conduit forming a discharge end;

discharge means at the discharge end of the inner conduit and the outer conduit for discharging an atomized spray which includes the air flow and the material flow, the discharge means being made of a wear-resistant and high temperature-resistant material; and means for channeling the air flow into the material flow at the discharge end for creating the atomized spray, the discharge means including a first wall, a second wall and a third wall, the first wall being connected to the second wall and the second wall being connected to the third wall, also the first wall, the second wall, the third wall and the means for channeling the air flow into the material flow defining an opening therebetween, the atomized spray being discharged through the opening.

2. The atomizer according to claim 1, wherein the means for channeling the air flow into the material flow comprises a plate having a plurality of passages therethrough, the plate being connected to the first wall and the third wall, the plate for channeling air from the space between the inner conduit and the outer conduit through the passages into the opening of the discharge means.

3. The atomizer according to claim 2, wherein each passage is at a different angle of inclination with respect to the axis of the atomizer.

4. The atomizer according to claim 3, wherein the opening is rectangular.

5. The atomizer according to claim 4, wherein each passage is rectangular.

6. The atomizer according to claim 5, wherein the wear-resistant and high temperature-resistant material is tungsten carbide.

7. The atomizer according to claim 3, wherein the atomized spray is discharged from the opening at an angle not greater than 60° with the axis of the atomizer.

8. The atomizer according to claim 3, wherein the material has a flow rate through the atomizer of 200 to 15000 lb/hr.

9. The atomizer according to claim 8, wherein the air has a flow rate of no greater than ½ lb. of air per pound of atomized material.

10. The atomizer according to claim 9, wherein the particles and agglomerates of the material have a diameter no greater than 75% of the smallest dimension of the opening.

11. The atomizer according to claim 3, wherein the material is a soil paste.

12. The atomizer according to claim 3, wherein the material is sludge.

13. The atomizer according to claim 3, wherein the material is a wet concrete mixture.

14. The atomizer according to claim 3, wherein the material is a slurry.

15. The atomizer according to claim 2, wherein each passage is of the same angle of inclination with respect to the axis of the atomizer.

* * * * *